US008783348B2

(12) United States Patent
Edwards et al.

(10) Patent No.: US 8,783,348 B2
(45) Date of Patent: Jul. 22, 2014

(54) SECONDARY FLOW PATH MODULE, GRAVEL PACKING SYSTEM INCLUDING THE SAME, AND METHOD OF ASSEMBLY THEREOF

(75) Inventors: Jeff S. Edwards, Cypress, TX (US); Luis A. Garcia, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 538 days.

(21) Appl. No.: 12/981,070

(22) Filed: Dec. 29, 2010

(65) Prior Publication Data

US 2012/0168159 A1 Jul. 5, 2012

(51) Int. Cl.

| | |
|---|---|
| ***E21B 43/04*** | (2006.01) |
| ***E21B 17/10*** | (2006.01) |
| ***E21B 43/08*** | (2006.01) |
| ***E21B 17/18*** | (2006.01) |

(52) U.S. Cl.

CPC ..... *E21B 43/04* (2013.01); *E21B 17/1035* (2013.01); *E21B 43/08* (2013.01); *E21B 17/18* (2013.01)

USPC ..... 166/278; 166/380; 166/51; 166/167

(58) Field of Classification Search

None

See application file for complete search history.

(56) References Cited

U.S. PATENT DOCUMENTS

| | | | | |
|---|---|---|---|---|
| 4,674,572 | A | 6/1987 | Gallus | |
| 5,332,038 | A | 7/1994 | Tapp et al. | |
| 5,341,880 | A * | 8/1994 | Thorstensen et al. | 166/278 |
| 5,390,966 | A * | 2/1995 | Cox et al. | 285/124.2 |
| 5,868,200 | A * | 2/1999 | Bryant et al. | 166/51 |
| 6,230,803 | B1 | 5/2001 | Morton et al. | |
| 6,540,022 | B2 | 4/2003 | Dusterhoft et al. | |
| 6,588,506 | B2 * | 7/2003 | Jones | 166/278 |
| 7,207,383 | B2 * | 4/2007 | Hurst et al. | 166/242.3 |
| 7,478,651 | B2 * | 1/2009 | Simpson | 138/98 |
| 7,584,799 | B2 | 9/2009 | Coronado et al. | |
| 7,661,476 | B2 | 2/2010 | Yeh et al. | |
| 2003/0047311 | A1 | 3/2003 | Echols | |
| 2004/0035579 | A1 | 2/2004 | Parlar | |
| 2004/0140089 | A1 * | 7/2004 | Gunneroed | 166/228 |
| 2005/0028977 | A1 | 2/2005 | Ward | |
| 2005/0061501 | A1 | 3/2005 | Ward | |
| 2006/0237197 | A1 | 10/2006 | Dale | |
| 2006/0283604 | A1 * | 12/2006 | Setterberg et al. | 166/380 |
| 2007/0131421 | A1 | 6/2007 | Hurst et al. | |
| 2008/0142227 | A1 * | 6/2008 | Yeh et al. | 166/369 |
| 2008/0190608 | A1 | 8/2008 | Coronado et al. | |
| 2009/0188666 | A1 | 7/2009 | Habib et al. | |
| 2010/0155064 | A1 * | 6/2010 | Nutley et al. | 166/278 |
| 2013/0248179 | A1 | 9/2013 | Yeh et al. | |

OTHER PUBLICATIONS

International Search Report and Written Opinion; Date of Mailing Jul. 18, 2012; International Applcation No. PCT/US2011/065837; Korean Intellectual Property Office; Internaltional Search Report 5 pages; Written Opinion 4 pages.

(Continued)

*Primary Examiner* — Jennifer H Gay
*Assistant Examiner* — Caroline Butcher
(74) *Attorney, Agent, or Firm* — Cantor Colburn LLP

(57) ABSTRACT

An apparatus for gravel packing includes a sand screen and a secondary flow path module. The module is installed over the sand screen with the sand screen positioned radially inward the secondary flow path module. The secondary flow path module includes a protective cover to which the secondary flow path hardware is attached on an interior of the protective cover.

18 Claims, 4 Drawing Sheets

(56) References Cited

OTHER PUBLICATIONS

Notification of Transmittal of the International Search Report and the Written Opinion of the International Searching Authority, or the Declaration; Korean Intellectual Property Office; PCT/US2011/063491; Jul. 25, 2012, International Search Report 5 pages; Written Opinion 4 pages.

Edment, "Improvements in Horizontal Gravel Packing". Oilfield Review. Spring 2005, pp. 50-60.

Sanders et al. "Gravel Pack Designs of Highly-Deviated Wells with an Alternative Flow-Path Concept." International Symposium and Exhibition on Formation Damage Control, Feb. 20-21, 2002, Lafayette, Louisiana. [Abstract and Introduction Only].

* cited by examiner

SECONDARY FLOW PATH MODULE, GRAVEL PACKING SYSTEM INCLUDING THE SAME, AND METHOD OF ASSEMBLY THEREOF

BACKGROUND

In oil and gas wells, a gravel packing assembly pumps gravel slurry down tubing and exits the tubing to allow the slurry to flow into an annulus formed between a screen and the well casing or open hole. The liquid in the slurry flows into the formation of the well and/or the openings in the screen, which are sized to prevent the gravel from entering the screen. The gravel collects around the screen to form the gravel pack. The gravel allows flow of produced fluids therethrough and into the screen while blocking the flow of particulates produced with the formation fluids.

When bridges caused by obstructions are created in the annulus, secondary flow path tubes, which are in fluid communication with the gravel slurry, allow the slurry to flow through the tubes and out into the annulus through emitters downstream of the bridge. Thus, the annulus below the bridge can be packed with the gravel. Where no annular obstruction exists, the secondary flow path tube is naturally bypassed for the easier flowing annulus.

When the secondary flow path tubes do become a slurry conduit, because of the high pressure in the secondary flow path tubes, the slurry tends to exit at a high velocity. Slurry being by nature erosive, a property exacerbated by high velocity, can detrimentally affect the secondary flow path tubes. The art has clamped the secondary flow paths to the outside of the sand screen and then has run an additional shroud over the paths. While the additional shroud helps protect the secondary flow paths during operation, the assembly process is complicated.

BRIEF DESCRIPTION

A secondary flow path module includes a protective cover; and secondary flow path hardware attached to an interior of the protective cover.

An apparatus for gravel packing, the apparatus includes a sand screen; and, a secondary flow path module installed over the sand screen, the sand screen positioned radially inward the secondary flow path module, the secondary flow path module including a protective cover; and secondary flow path hardware attached to an interior of the protective cover.

A method of assembling a gravel packing system, the method includes affixing secondary flow path hardware to an interior of a protective cover to form an secondary flow path module; and, subsequently installing the secondary flow path module over a sand screen.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
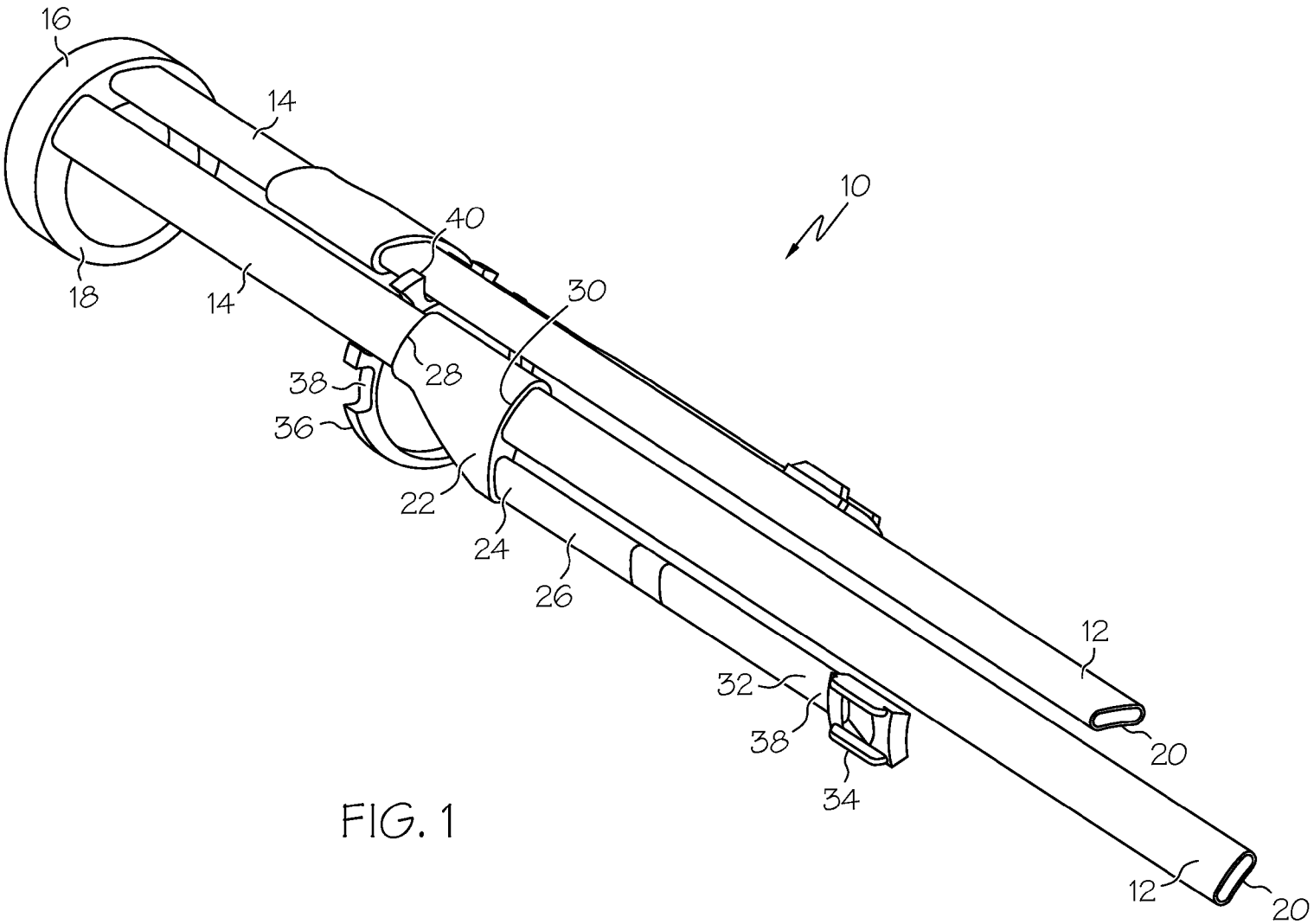
FIG. 1 depicts a perspective view of exemplary secondary flow path hardware.
Figure 2:
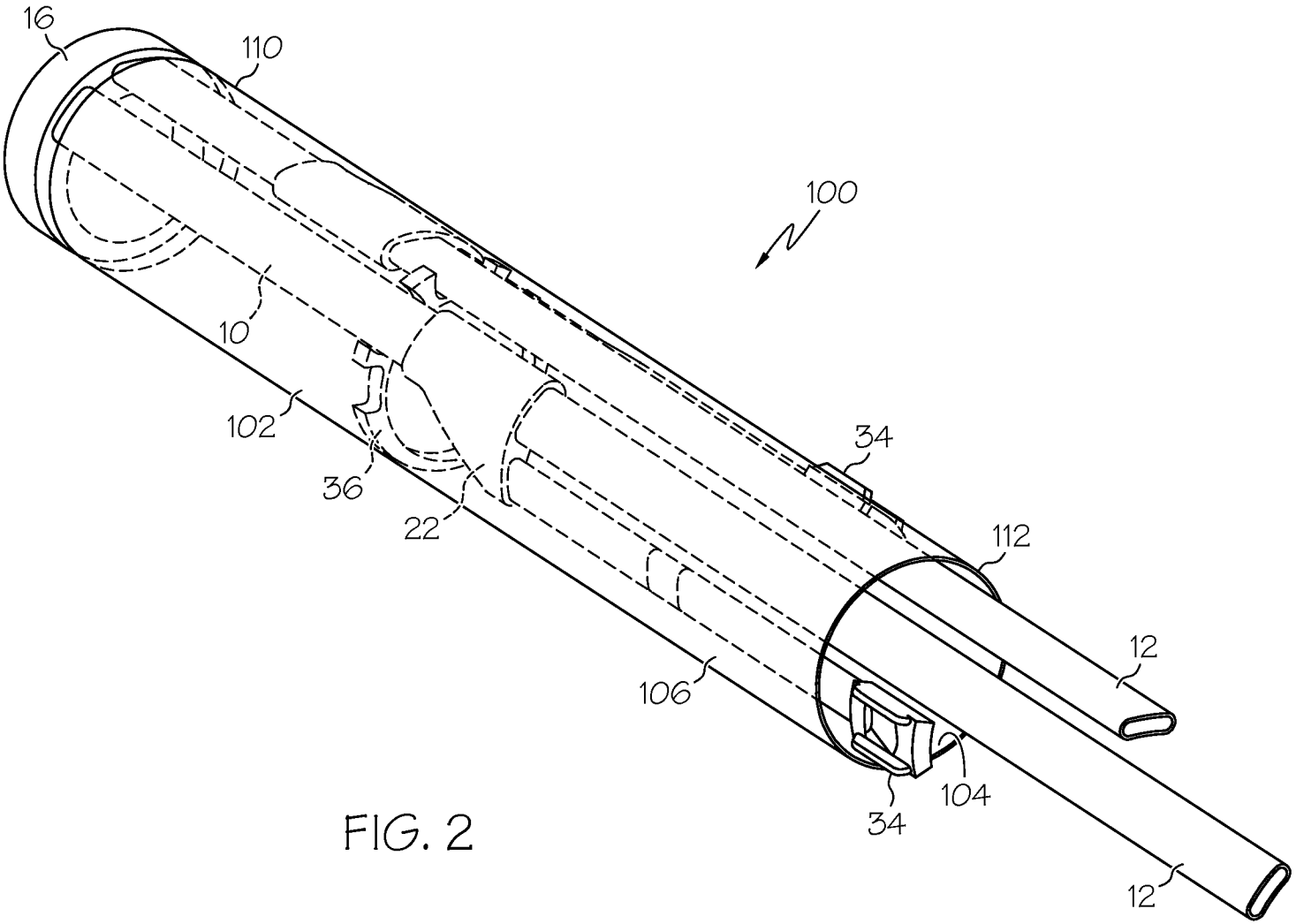
FIG. 2 depicts a perspective view of an exemplary secondary flow path module.

FIG. 1 shows an exemplary embodiment of alternate flow path hardware 10 usable in a secondary flow path module 100, shown in FIG. 2. The secondary flow path hardware 10 includes a plurality of slurry transport tubes 12 of varying lengths. While two slurry transport tubes 12 are shown in FIG. 1, it should be understood that any number of slurry transport tubes 12, in any variety of lengths, may be included in the secondary flow path hardware 10. A connecting portion 14 of the slurry transport tubes 12 is connected to an end cap 16, which is tubular and may be substantially ring-shaped. The slurry transport tubes 12 are radially distributed about a longitudinal axis passing centrally through the end cap 16. The end cap 16 includes an inner boundary having an inner diameter of the end cap 16 and an outer boundary having an outer diameter of the end cap 16. The connecting portions 14 of the slurry transport tubes 12 are connected to the end cap 16 on a face 18 of the end cap 16 that lies within a plane that intersects the longitudinal axis. Each of the slurry transport tubes 12 includes a passageway 20 that can be in fluid communication with gravel slurry. In one exemplary embodiment, the passageway 20 has a cross-section that includes a radially larger boundary, a radially smaller boundary, and two semicircular boundaries that laterally join the radially larger boundary to the radially smaller boundary. Such a shape of the passageway 20 assists in limiting the overall outside dimension of the secondary flow path module 100.

The slurry transport tube 12 may also be advantageously connected to splitter 22, which connects the slurry transport tube 12 to a first end 24 of an emitter tube 26. The splitter 22 and the emitter tube 26 may also share substantially the same curved cross-sectional shape as the passageway 20, although the slurry transport tube 12 may be generally wider than the emitter tube 26. The splitter 22 includes a first end 28 that is slightly wider than the connecting portion 14 of the slurry transport tube 12, and a second end 30 that is slightly wider than both the slurry transport tube 12 and the emitter tube 26 combined. In an exemplary embodiment, the first end 28 of the splitter 22 is located closer to the end cap 16 than the second end 30 of the splitter 22, and the first end 28 of the splitter 22 is narrower than the second end 30 of the splitter 22. The splitters 22 of the secondary flow path hardware 10 may be positioned at different longitudinal locations of the secondary flow path hardware 10, such that the connecting portions 14 are of varying lengths. A second end 32 of the emitter tube 26 is connected to an emitter 34, which extends radially outward, with respect to the emitter tube 26, from the longitudinal axis of the secondary flow path hardware 10. The emitter 34 opens radially outward, such that slurry passing longitudinally along the emitter tube 26 is redirected outwardly into the annulus between the tool and a well casing. The second ends 32 of the emitter tubes 26 of the secondary flow path hardware 10 are positioned at varying longitudinal locations with respect to the secondary flow path hardware 10. The emitters 34 of the secondary flow path hardware 10, which are connected to the second ends 32 of the emitter tubes 26, are likewise distributed at varying longitudinal locations. While a particular arrangement of splitters 22 and emitters 34 is described, it would be within the scope of these embodiments to employ an alternate design, arrangement and/or number of splitters and emitters within the secondary flow path hardware 10.

The secondary flow path hardware 10 further includes a tubular shaped support ring 36, such as a centering ring. In an exemplary embodiment, the centering ring 36 shares the same longitudinal axis as the end cap 16. An inner boundary of the centering ring may have an inner diameter of the centering ring 36. An outer boundary of the centering ring 36 includes notches or grooves 38 shaped to receive the slurry transport tubes 12 therein. The grooves 38 may be sized such that an upper edge portion 40 of the grooves 38 partially traps the slurry transport tubes 12 that are nested within the grooves 38. The number of the notches or grooves 38 is variable, and the centering ring 36 should include at least one groove 38 for every slurry transport tube 12 that passes over the centering ring 36. In the illustrated embodiment, only one centering ring 36 is shown, however it is also within the scope of these embodiments to utilize multiple centering rings 36 positioned at different longitudinal locations of the secondary flow path hardware 10.

Figure 3:
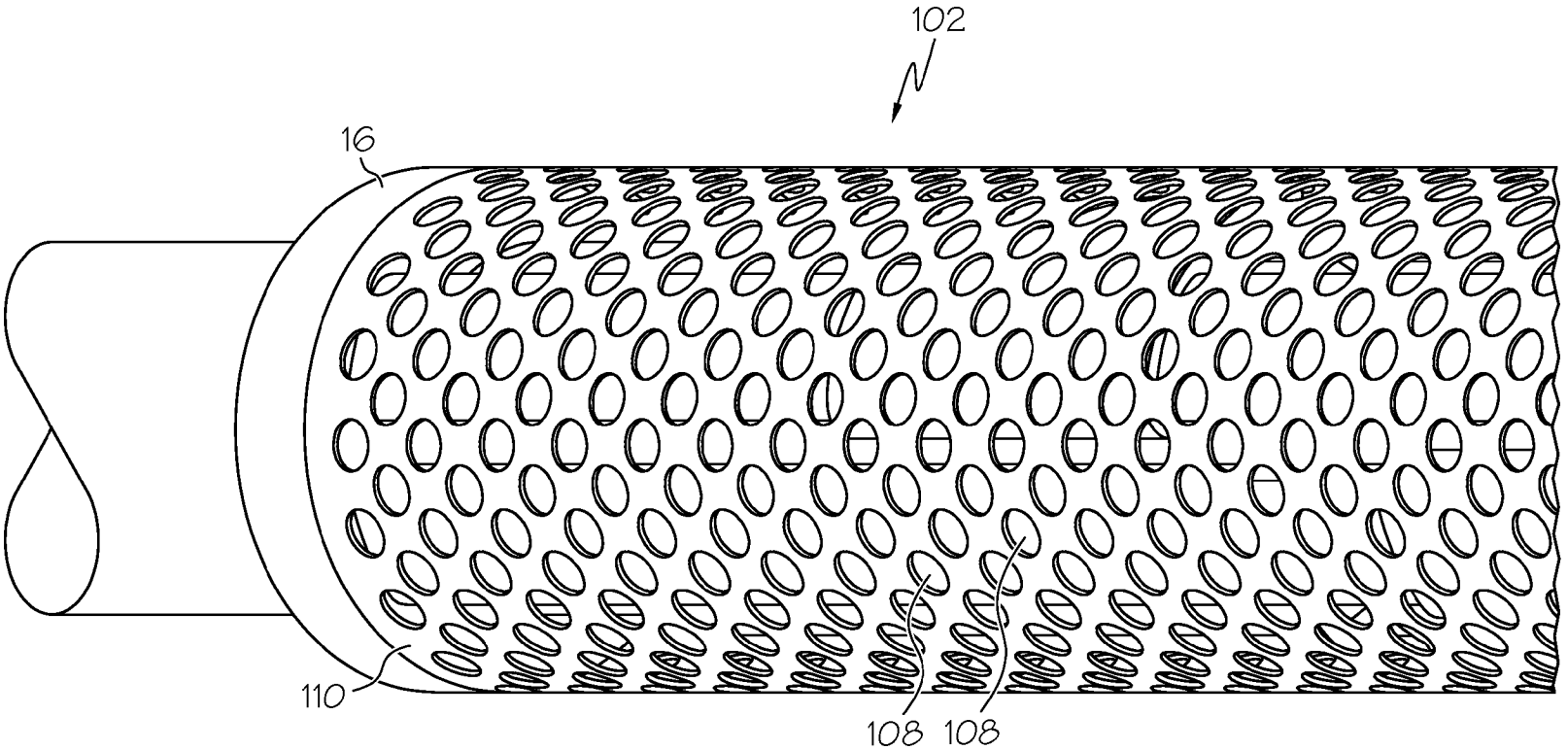
FIG. 3 depicts an exemplary protective cover assembled with secondary flow path hardware; and, FIG. 4 depicts a perspective view of the exemplary secondary flow path module installed on an exemplary well tool.

Turning to FIG. 2, an exemplary embodiment of the secondary flow path module 100 is shown to include the secondary flow path hardware 10 of FIG. 1 encased within a tubular protective cover 102. The protective cover 102 includes an inner surface 104 having an inner diameter and an outer cylindrical surface 106 having an outer diameter. For clarity, the protective cover 102 is shown in FIG. 2 without perforations, but includes perforations 108 as shown in FIG. 3, wherein such perforations 108 extend from the inner surface 104 to the outer surface 106. The end cap 16 may be attached to the protective cover 102 as shown in FIG. 3, such as by welding or other means of affixing. An outside diameter of the protective cover 102 may be substantially the same as an outside diameter of the end cap 16. Other than the end cap 16 and the emitters 34, the elements of the secondary flow path hardware 10 are positioned radially inward from the protective cover 102. The emitters 34 protrude radially outward from the protective cover 102, including any emitters 34 that are located longitudinally within the length of the protective cover 102 from a first end 110 of the protective cover 102 adjacent the end cap 16 to a second end 112 of the protective cover 102. In the illustrated embodiment, ends of the slurry transport tubes 12 extend beyond the second end 112 of the protective cover 102.

In one exemplary method of assembling the secondary flow path module 100, a section of perforated sheet metal is first selected. The section of perforated sheet metal is then formed into a tube and seam welded or otherwise retained in a tubular shape. The alternate flow path hardware 10 is then welded or otherwise affixed into the interior 104 of the cover 102. This may be accomplished, in one exemplary embodiment, by attaching the end cap 16 of the secondary flow path hardware 10 to the first end 110 of the protective cover 102. Affixing the other components of the secondary flow path hardware 10 to the protective cover 102 may also be accomplished by welding or otherwise securing the components to the inside surface 104 of the protective cover 102, such as through the perforations 108. While a particular arrangement of secondary flow path hardware 10 has been described, it should be noted that the secondary flow path hardware 10 can include, but is not limited to, any arrangement of tubing, diffusers, nozzles, splitters, and support rings.

Figure 4:
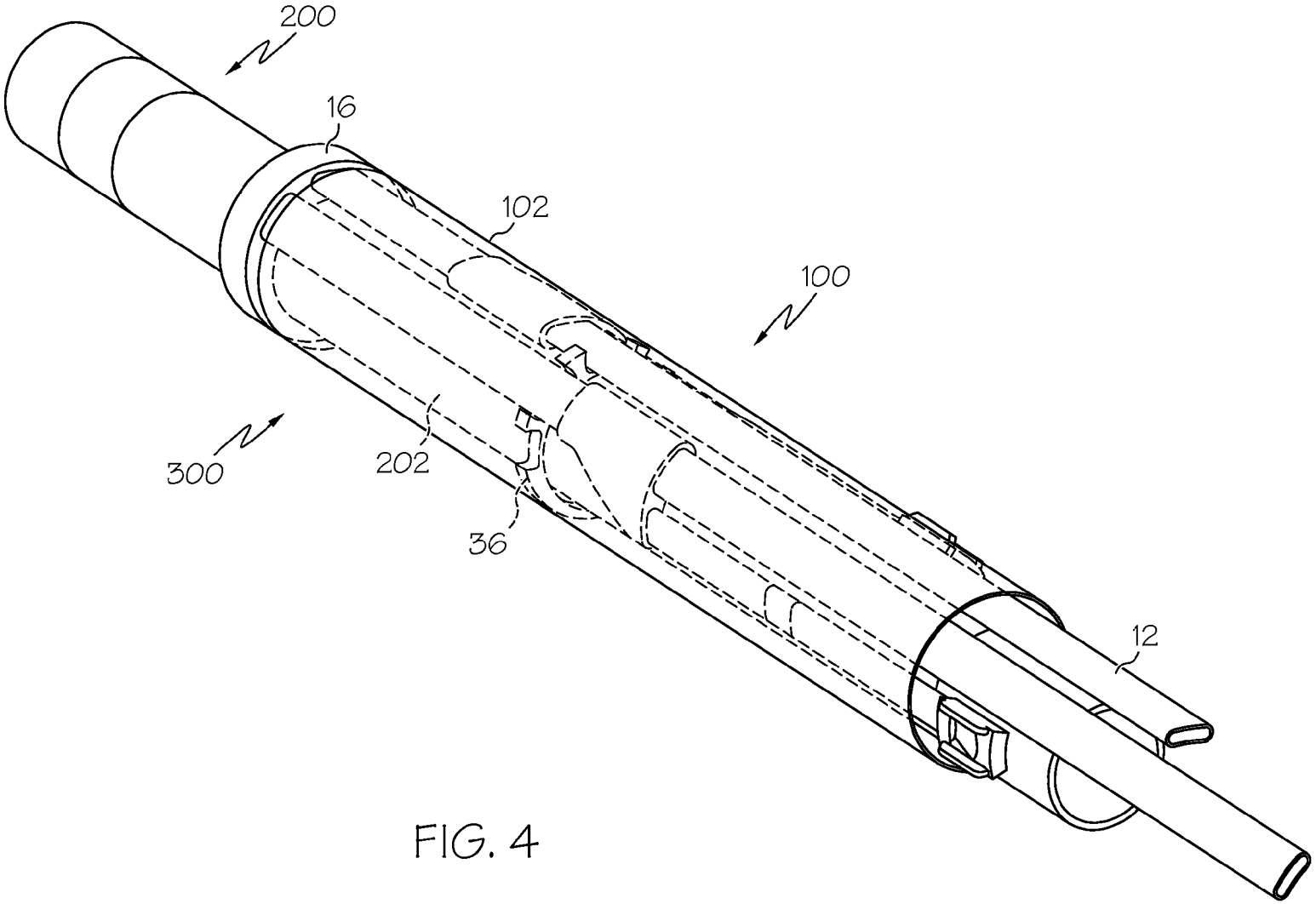

With reference to FIG. 4, upon completion of the secondary flow path module 100, the secondary flow path module 100 is ready for installation on a well tool 200, such as, but not limited to, a gravel packing apparatus having a sand screen 202. For clarity, the screen 202 is not shown in detail, however such screens are known to the art and do not require explanation here. The inner boundary of the end cap 16 and the inner boundary of the support ring 36 encircle an outer boundary of the tool 200, such that the secondary flow path module 100 may easily slide into place over the tool 200. The inner diameter of the end cap 16 may be sized to encircle the tool 200 and the inner diameter of the support ring 36 may be sized to encircle a different longitudinal location of the tool 200. While the inner diameters of the end cap 16 and the support ring 36 may be the same, in an alternate exemplary embodiment, the inner diameter of the support ring 36 is different than the inner diameter of the end cap 16 when the tool 200 includes sections having various diameters, such that one of the support ring 36 and the end cap 16 passes over a wider section of the tool 200, but the other of the support ring 36 and end cap 16 abuts with the wider section of the tool 200 to position the secondary flow path module 100 in location on the tool 200.

With the components of the secondary flow path hardware 10 affixed inside of the protective cover 102, and with the secondary flow path module 100 assembled onto existing screen joints of a well oil tool 200, the assembly process for the final tool 300 is simplified, while the screen 202 and protective cover 102 offer protection against damage to the alternate flow path components during run in.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A secondary flow path module comprising:

a protective cover; and secondary flow path hardware including an end cap and slurry transport tubes extending from the end cap, the end cap attached to a first end of the protective cover, and at least one portion of the secondary flow path hardware spaced from the end cap is directly attached to an interior of the protective cover, the at least one portion spaced from the end cap and directly attached to the interior of the protective cover including a support ring;

wherein the module is a self-contained unit configured to be slidably installable onto a tool.

2. The secondary flow path module of claim 1 wherein the end cap is tubular.

3. The secondary flow path module of claim 1 wherein the tubes of the secondary flow path hardware are disposed between the support ring and the protective cover.

4. The secondary flow path module of claim 1 wherein the support ring includes grooves for supporting the tubes of the secondary flow path hardware.

5. The secondary flow path module of claim 1 wherein the slurry transport tubes have a cross-sectional shape including a first boundary section, a second boundary section having a radially smaller boundary than the first boundary section, and two semicircular boundary sections that laterally join the first boundary section to the second boundary section.

6. The secondary flow path module of claim 1 wherein the secondary flow path hardware further includes a plurality of splitters, emitter tubes, and emitters.

7. The secondary flow path module of claim 6, wherein the emitter tubes extend longitudinally and the emitters open radially outwardly, the emitters configured to redirect longitudinally passing slurry from the emitter tubes in a radially outward direction.

8. The secondary flow path module of claim 7 wherein at least one of the emitters is disposed between a first end and a second end of the protective cover.

9. The secondary flow path module of claim 1 wherein the protective cover is perforated and the at least one portion of the secondary flow path hardware spaced from the end cap is welded to the interior of the protective cover via perforations in the protective cover.

10. An apparatus for gravel packing, the apparatus comprising:

a sand screen; and, a secondary flow path module installed over the sand screen, the sand screen positioned radially inward the secondary flow path module, the secondary flow path module comprising:

a protective cover; and secondary flow path hardware including an end cap, and slurry transport tubes extending from the end cap, the end cap attached to a first end of the protective cover, and at least one portion of the secondary flow path hardware spaced from the end cap is directly attached to an interior of the protective cover;

wherein the module is a self-contained unit configured to be slidably installable onto the sand screen as a unit.

11. The apparatus for gravel packing of claim 10, wherein the at least one portion of the secondary flow path hardware includes a support ring spaced from the end cap, the tubes extending between the support ring and the protective cover.

12. The apparatus for gravel packing of claim 10, wherein the secondary flow path hardware further includes a plurality of emitter tubes and emitters, and the emitter tubes extend longitudinally and the emitters open radially outwardly, the emitters configured to redirect longitudinally passing slurry from the emitter tubes in a radially outward direction, and at least one of the emitters disposed between a first end and a second end of the protective cover.

13. The apparatus for gravel packing of claim 10, wherein the protective cover is perforated and the at least one portion of the secondary flow path hardware spaced from the end cap is welded to the interior of the protective cover via perforations in the protective cover.

14. A method of assembling a gravel packing system, the method comprising:

affixing secondary flow path hardware to an interior of a protective cover by welding at least one of slurry transport tubes, splitter, support ring, emitter tubes and emitters to the interior of the protective cover and attaching the protective cover to an end cap of the secondary flow path hardware to form a secondary flow path module; and, subsequently installing the secondary flow path module over a sand screen, wherein subsequently installing the secondary flow path module over a sand screen includes sliding an entirety of the secondary flow path module over the sand screen.

15. The method of claim 14, further comprising forming a perforated sheet metal into a cylinder to form the protective cover.

16. The method of claim 15, further comprising seam welding the cylinder.

17. The method of claim 14, wherein subsequently installing the secondary flow path module over a sand screen includes assembling the secondary flow path module onto screen joints.

18. The method of claim 14, further comprising extending tubes of the secondary flow path hardware from an end cap and passing the tubes through grooves of a support ring, wherein affixing the secondary flow path hardware to an interior of a protective cover further includes trapping the tubes between the protective cover and the support ring.

* * * * *